US008205942B2

(12) United States Patent
Vestweber

(10) Patent No.: US 8,205,942 B2
(45) **Date of Patent: *Jun. 26, 2012**

(54) STADIUM SEAT

(75) Inventor: Nikki Vestweber, Manhattan, KS (US)

(73) Assignee: Cushion Seats, Inc., Manhattan, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/094,630

(22) Filed: Apr. 26, 2011

(65) Prior Publication Data

US 2011/0272984 A1 Nov. 10, 2011

Related U.S. Application Data

(63) Continuation of application No. 12/871,753, filed on Aug. 30, 2010, now Pat. No. 7,931,336, which is a continuation of application No. 12/349,375, filed on Jan. 6, 2009, now Pat. No. 7,784,868, which is a continuation of application No. 11/970,287, filed on Jan. 7, 2008, now Pat. No. 7,488,037, which is a continuation of application No. 11/243,615, filed on Oct. 5, 2005, now Pat. No. 7,316,452.

(60) Provisional application No. 60/665,986, filed on Mar. 29, 2005.

(51) Int. Cl.
*A47C 1/16* (2006.01)

(52) U.S. Cl. ..... 297/252; 297/352

(58) Field of Classification Search ..... 297/252, 297/352

See application file for complete search history.

(56) References Cited

U.S. PATENT DOCUMENTS

| | | | | | |
|---|---|---|---|---|---|
| 116,934 | A | * | 7/1871 | Cutter | 297/252 |
| 653,105 | A | * | 7/1900 | MacLeay | 297/188.1 |
| 816,545 | A | * | 3/1906 | Field | 297/352 |
| 1,213,762 | A | * | 1/1917 | Dunn | 297/252 |
| 1,293,778 | A | * | 2/1919 | Holm | 297/252 |
| 1,515,564 | A | * | 11/1924 | Field | 297/250.1 |
| 2,004,247 | A | * | 6/1935 | McCaul | 224/103 |
| 2,046,198 | A | * | 6/1936 | Letts | 297/252 |
| 2,059,493 | A | * | 11/1936 | Schoenhoff | 297/252 |
| 2,137,312 | A | * | 11/1938 | Thompson | 297/252 |
| 2,152,014 | A | * | 3/1939 | Ashe et al. | 297/252 |
| 2,276,308 | A | * | 3/1942 | Hugh | 446/482 |
| 2,287,611 | A | * | 6/1942 | Harbison | 312/313 |
| 2,306,673 | A | * | 12/1942 | Tucker | 297/252 |
| 2,475,962 | A | * | 7/1949 | Horn | 297/252 |
| 2,491,784 | A | * | 12/1949 | Thompson | 297/252 |
| 2,509,420 | A | * | 5/1950 | Burch | 297/252 |
| 2,545,840 | A | * | 3/1951 | Browne | 297/252 |
| 2,558,315 | A | * | 6/1951 | Pavey et al. | 297/352 |
| 2,571,282 | A | * | 10/1951 | Newton et al. | 297/252 |
| 2,725,925 | A | * | 12/1955 | Sanderson et al. | 297/252 |
| 2,736,365 | A | * | 2/1956 | Hines | 297/183.5 |
| 2,792,875 | A | * | 5/1957 | Pirrone | 297/252 |
| 2,816,871 | A | * | 12/1957 | Fish | 297/217.1 |
| 2,865,433 | A | * | 12/1958 | Warner | 383/25 |
| 2,954,125 | A | * | 9/1960 | Husted | 108/62 |
| 2,957,515 | A | * | 10/1960 | Gibson | 297/252 |

(Continued)

*Primary Examiner* — Rodney B White

(74) *Attorney, Agent, or Firm* — McAndrews, Held & Malloy, Ltd.

(57) ABSTRACT

A seat frame of a stadium seat includes a lower cross beam, bench-engaging support arms configured to mount over a top, flat surface of the stadium bench, and upright support members. The upright support members include rounded upper ends that may be rearwardly canted.

18 Claims, 18 Drawing Sheets

U.S. PATENT DOCUMENTS 3,026,142 A * 3/1962 Holloway ..... 297/252
3,066,980 A * 12/1962 Clute ..... 297/252
3,153,526 A * 10/1964 Pawsey ..... 248/219.1
3,279,620 A * 10/1966 Nesbitt ..... 211/106.01
3,288,414 A * 11/1966 Fortunato ..... 248/222.12
3,393,888 A * 7/1968 Henningsgard ..... 248/230.8
D216,158 S * 11/1969 Williams ..... D25/68
3,594,039 A * 7/1971 Harp ..... 297/252
3,672,624 A * 6/1972 Keller ..... 248/243
3,675,882 A * 7/1972 Dibble ..... 248/235
3,695,569 A * 10/1972 Pullan ..... 248/235
3,797,790 A * 3/1974 Iseki ..... 248/230.2
3,900,110 A * 8/1975 Soroka ..... 211/113
3,994,529 A * 11/1976 Lippert ..... 297/252
4,036,369 A * 7/1977 Eisenberg ..... 211/88.02
4,094,415 A * 6/1978 Larson ..... 211/57.1
4,269,381 A * 5/1981 Harms ..... 248/465.1
4,367,819 A * 1/1983 Lewis ..... 211/59.1
4,469,031 A * 9/1984 Haycock ..... 108/147.17
4,611,852 A * 9/1986 Filer ..... 297/352
4,688,683 A * 8/1987 Thalenfeld et al. ..... 211/57.1
D293,282 S * 12/1987 Ashford ..... D6/368
4,809,941 A * 3/1989 Sheridan ..... 248/249
4,898,355 A * 2/1990 Steinway ..... 248/235
5,029,350 A * 7/1991 Edelson ..... 5/652
5,042,875 A * 8/1991 Biggs, Sr. ..... 297/252
5,044,505 A * 9/1991 Spratt ..... 211/22
D328,506 S * 8/1992 McMahon ..... D30/118
D337,938 S * 8/1993 Shaw et al. ..... D8/380
D344,868 S * 3/1994 Martinell ..... D6/552
5,388,709 A * 2/1995 Adams ..... 211/70.6
D357,609 S * 4/1995 Webb et al. ..... D6/596
D360,308 S * 7/1995 Smith et al. ..... D6/333
D363,951 S * 11/1995 Chatman ..... D20/42
D369,929 S * 5/1996 Perry ..... D6/501
5,516,193 A * 5/1996 Simpson ..... 297/252
5,533,219 A * 7/1996 Meyers ..... 5/653
5,580,130 A * 12/1996 Williams et al. ..... 297/352
5,842,581 A * 12/1998 Graefe ..... 211/17
D413,733 S * 9/1999 Edmonds ..... D6/336
D417,353 S * 12/1999 Laga ..... D6/566
D423,269 S * 4/2000 Laga et al. ..... D6/566
D427,824 S * 7/2000 Osburn et al. ..... D6/511
D428,720 S * 8/2000 Rutherford ..... D6/356
6,209,837 B1 * 4/2001 Harms ..... 248/302
D449,947 S * 11/2001 Schoefer ..... D6/500
6,352,306 B1 * 3/2002 Dreiling ..... 297/252
D468,548 S * 1/2003 Head, Jr. ..... D6/368
6,502,902 B1 * 1/2003 Romero ..... 297/352
D474,934 S * 5/2003 Ildstad et al. ..... D6/601
6,581,789 B1 * 6/2003 Spanski et al. ..... 211/106
6,588,840 B1 * 7/2003 Lombardo ..... 297/228.12
6,592,187 B2 * 7/2003 Calvery ..... 297/352
6,739,667 B1 * 5/2004 Jones ..... 297/352
6,823,999 B2 * 11/2004 Heneveld, Sr. ..... 211/87.01
6,926,360 B2 * 8/2005 Jones ..... 297/252
7,104,605 B2 * 9/2006 Jones ..... 297/352
D553,884 S * 10/2007 Faber et al. ..... D6/500
D555,947 S * 11/2007 Vestweber ..... D6/500
7,316,452 B2 * 1/2008 Vestweber ..... 297/252
7,374,246 B2 * 5/2008 Jones ..... 297/352
D577,932 S * 10/2008 Vestweber ..... D6/500
D580,688 S * 11/2008 Vestweber ..... D6/500
D584,081 S * 1/2009 Vestweber ..... D6/500
7,488,037 B2 * 2/2009 Vestweber ..... 297/252
7,575,275 B2 * 8/2009 Jones ..... 297/252
7,784,868 B2 * 8/2010 Vestweber ..... 297/252
7,931,336 B2 * 4/2011 Miller ..... 297/252
2004/0212233 A1 * 10/2004 Jones ..... 297/252
2005/0127731 A1 * 6/2005 Jones ..... 297/352
2006/0250010 A1 * 11/2006 Jones ..... 297/352
2007/0018491 A1 * 1/2007 Jones ..... 297/352
2008/0093902 A1 * 4/2008 Jones ..... 297/252
2009/0212614 A1 * 8/2009 Isaac ..... 297/252

* cited by examiner

STADIUM SEAT

RELATED APPLICATIONS

This application is a continuation of U.S. Ser. No. 12/871,753, entitled "Stadium Seat," filed Aug. 30, 2010, now U.S. Pat. No. 7,931,336, which in turn is a continuation of Ser. No. 12/349,375, entitled "Stadium Seat," filed Jan. 6, 2009, now U.S. Pat. No. 7,784,868, which in turn is a continuation of U.S. Ser. No. 11/970,287, entitled "Stadium Seat," filed Jan. 7, 2008, now U.S. Pat. No. 7,488,037, which in turn is a continuation of U.S. Ser. No. 11/243,615 entitled "Stadium Seat," filed Oct. 5, 2005, now U.S. Pat. No. 7,316,452, which in turn relates to and claims priority benefits from U.S. Provisional Patent Application No. 60/665,986 entitled "Stadium Seat," filed Mar. 29, 2005, all of which are incorporated by reference herein in their entireties.

BACKGROUND OF THE INVENTION

Embodiments of the present invention generally relate to a stadium seat, and more particularly to a seat for semi-permanent attachment to a stadium bench.

Many stadiums, arenas, amphitheaters, and other such venues (collectively referred to as "stadiums") include a seating area having stadium benches or bleachers for spectators to sit. Typically, the stadium benches are flat, hard benches of metal or wood that are supported by stepped risers that provide a tiered seating arrangement.

Some venues include supplemental seating that provides greater comfort for spectators by utilizing a seat that has a frame, cushion and back portion that may be positioned with respect to the stadium bench to provide a cushioned seat and a backrest for the spectators. These stadium seats may be rented by vendors and taken into the stadium by the user, temporarily attached to the stadium bench and then left at the conclusion of the event.

Organizations sponsoring events in stadiums have found it desirable to provide, for their spectators, alumni and customers, seats that are semi-permanently attached to the stadium bench and that remain in place during an entire season of events or, for that matter, throughout the year. As such, there is no need to buy or rent these seats from a vendor. Semi-permanent stadium seating also provides users with seats that are fixed at the positions of use in the stadium. Further, season ticket holders may rest assured knowing that the semi-permanent seats will remain in place for a series of events in the stadium.

U.S. Pat. No. 6,739,667 (the "Jones '667 patent"), and United States Patent Application Publication 2004/0212233, both entitled "Stadium Chair," and U.S. Pat. No. 3,066,980, entitled "Foldable Stadium Chair" (the "Clute '980 patent"), all disclose stadium chairs having an upper cross beam integrally connected to upright support members. When a user sits back in these stadium chairs, the upper cross beam is urged into the mid or upper back of the user, which may cause discomfort to the user. Further, the upper cross beam remains relatively rigid and does not conform to the contours of the user's back.

Thus, a need exists for a comfortable stadium seat that is more comfortable than the stadium seats described above. In particular, a need exists for an improved stadium seat that provides adequate support to a user, while at the same time comfortably conforms to the shape of the user's back.

SUMMARY OF THE INVENTION

Certain embodiments of the present invention provide a seat frame of a seat for semi-permanent attachment to a stadium bench supported on a stadium riser. The stadium bench includes a top, flat surface for seating, a front portion that extends beyond the stadium riser, opposed, spaced front and rear vertical walls extending downwardly from the top surface, and flanges extending inwardly from the bottom of each wall.

The seat frame includes a lower cross beam, bench-engaging support arms configured to mount over the top, flat surface of the stadium bench, and upright support members that are integrally connected to the lower cross beam. The upright support members may include rounded, smoothed, or otherwise blunted upper ends. The rounded upper ends may be rearwardly canted with respect to a vertical plane occupied by the lower cross beam.

Embodiments of the present invention may also include at least one angled brace integrally connected to one of the upright support members and the lower cross beam. The angled brace may connect to a point that is proximate a midpoint of the upright support member. Additionally, the angled brace may connect to a point that is proximate an end of the lower cross beam.

In general, certain embodiments of the present invention may be devoid of an upper cross beam connecting upper portions of the upright support members.

Certain embodiments of the present invention may also include a bench engagement member defined by upper and lower prongs. The lower prong may be integrally connected to the upper prong, which may be one of the bench-engaging support arms through an intermediate upright, which may be a portion of an upright support. A bench retention cavity is defined between the upper prong, such as the bench-engaging support arm, and the lower prong. The stadium bench is configured to be sandwiched between the upper and lower prongs within the bench retention cavity. The seat frame may be mounted to the stadium bench by urging the seat frame into the stadium bench through a rear end of the stadium bench.

Figure 1:
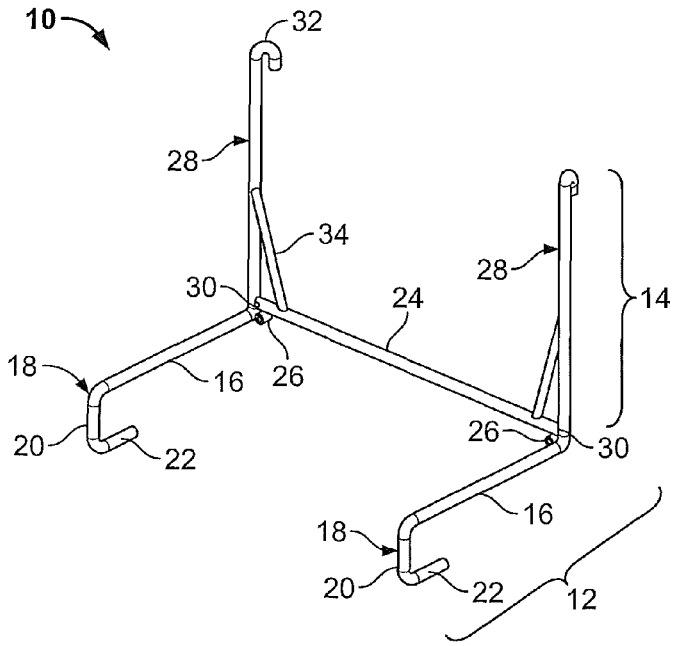
FIG. 1 illustrates an isometric view of a seat frame according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements, ornamental appearances, and instrumentalities shown in the attached drawings and that various structural designs can achieve the described functions.

DETAILED DESCRIPTION OF THE INVENTION

FIG. 1 illustrates an isometric view of a seat frame 10 according to an embodiment of the present invention. The seat frame 10 includes a seat portion 12 integrally formed with a back portion 14. The seat portion 12 includes horizontal support arms 16 integrally connected to forward hooks 18. The horizontal support arms 16 are adapted to mount over a seating area of a stadium bench or bleacher (not shown in FIG. 1). Each hook 18 includes a vertical leg 20, which is configured to extend downwardly along a front wall of the stadium bench, and a horizontal hooking arm 22, which is configured to extend rearwardly beneath the stadium bench.

A lower support cross beam 24 is integrally connected to the horizontal support arms 16 proximate the rear of the seat frame 10. Optionally, the lower support cross beam 24 may extend between front ends of the horizontal support arms 16. Also, alternatively, the seat frame 10 may include multiple lower support cross beams 24 near front and rear ends. For example, one support cross beam 24 may be near the forward hooks 18, while an additional cross beam may extend between rear ends of the horizontal support arms 16. The lower support cross beam 24 is horizontally oriented and perpendicular to each of the horizontal support arms 16. Mounting receptacles 26 are integrally connected to the cross beam 24. As shown in FIG. 1, two mounting receptacles 26 are positioned underneath the cross beam 24 proximate the junctions of the cross beam 24 and the horizontal support arms 16. Each receptacle 26 may also be integrally connected to a horizontal support arm 16. Optionally, each receptacle 26 may only be integrally connected to a horizontal support arm 16. The mounting receptacles 26 may be configured to securely engage a fastening member, such as a bolt, screw, or strap. Optionally, the mounting receptacles 26 may be configured to snapably, latchably, or otherwise removably engage a corresponding fastener.

The back portion 14 includes two upwardly-extending back rest support members 28. The support members 28 are oriented in a substantially upright or vertical position and extend upwardly from points that are proximate the ends 30 of the lower support cross beam 24. Each support member 28 includes a rounded, smoothed, or otherwise blunted upper end 32. There are a variety of designs that may achieve this goal. For example, as shown in FIG. 1, the ends of the support members 28 may be curled under to provided the rounded upper ends 32. Braces 34 are integrally connected to the support members 28 and the lower support cross beam 24.

Figure 2:
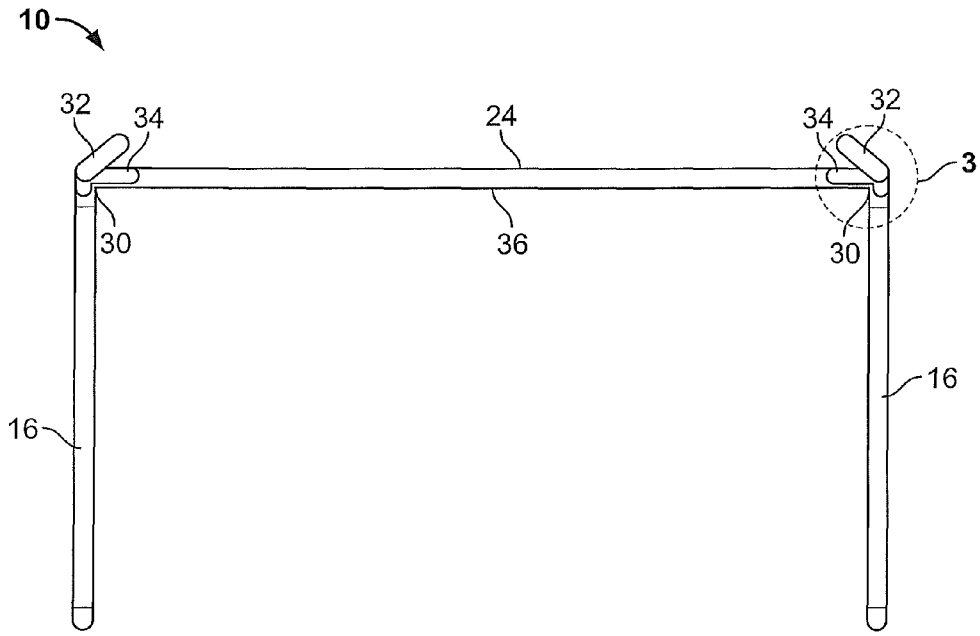
FIG. 2 illustrates a top view of a seat frame according to an embodiment of the present invention.

FIG. 2 illustrates a top view of the seat frame 10. As shown in FIG. 2, the braces 34 integrally connect to points on the lower support cross beam 24 that are closer to the ends 30 of the cross beam 24 as opposed to a midpoint 36 of the cross beam 24. The braces 34 may connect at various points along the cross beam 24, even the midpoint 36. Preferably, the braces 34 connect to the lower cross beam 24 proximate the ends 30 of the cross beam to provide greater comfort to one seated in a stadium seat. That is, positioning the braces 34 as shown in FIGS. 1 and 2, for example, provides bracing support to the support members 28, while at the same time maintaining an open area for a user's lower back, thereby minimizing uncomfortable protrusions. In general, the braces 34 are oriented to loosely silhouette the shape of a normal human lower back. Overall, this aspect of the embodiment may be achieved using a variety of structures and designs.

As shown in FIG. 2, the upper ends 32 of the support members 28 are also rearwardly canted. In particular, the upper ends 32 are canted away from a vertical plane occupied by the lower support cross beam 24.

Figure 3:
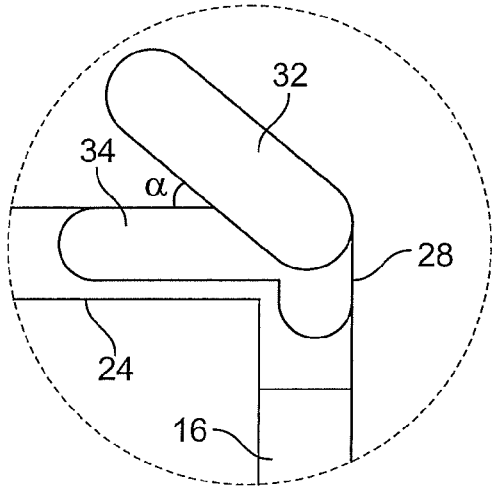
FIG. 3 illustrates a detailed expanded top view of a rounded upper end of a support member shown in section A of FIG. 2.

FIG. 3 illustrates a detailed expanded top view of the rounded upper end 32 of the support member 28 shown in section A of FIG. 2. As shown in FIG. 3, the rounded upper end 32 is canted rearwardly at an angle $\alpha$ with respect to a vertical plane occupied by the brace 34 and the lower support cross beam 24. In the embodiments shown, the angle $\alpha$ is forty-five degrees. It has been found that this angular orientation conforms closely to the shape of a normal human back. Additionally, as discussed below, the rearwardly-canted upper ends 32 ensure that a flexible backrest (not shown in FIG. 3) remains taut and secured between the support members 28.

Alternatively, the upper ends 32 may be rearwardly canted at a variety of angles. Also, alternatively, the upper ends 32 may be coplanar with a vertical plane occupied by the lower support cross beam 24, or the horizontal support arm 16. That is, the upper ends 32 may alternatively be aligned with either the lower support cross beam 24 or the horizontal support arm 16.

Figure 4:
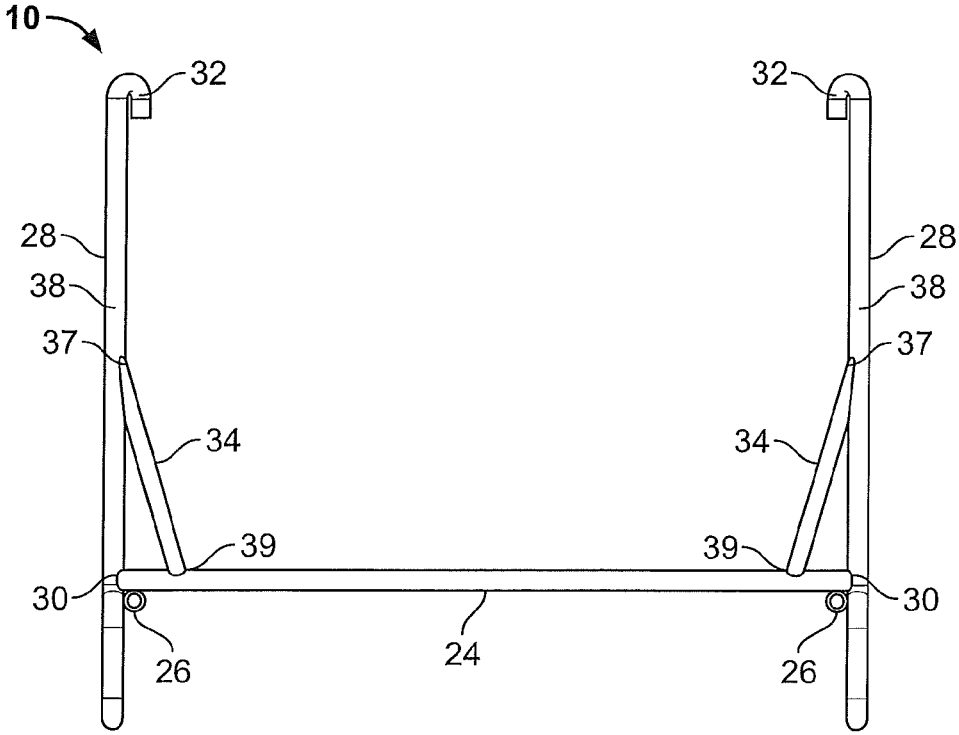
FIG. 4 illustrates a front view of a seat frame according to an embodiment of the present invention.

FIG. 4 illustrates a front view of the seat frame 10. As shown in FIG. 4, the braces 34 integrally connect to points 37 proximate midpoints 38 of the support members 28, and to points 39 proximate the ends 30 of the lower support cross beam 24. The braces 34 act to brace the support members 28 and prevent them from bending inwardly toward one another. As noted above, the braces 34 may be any length and connect to various points along the support members 28 and the lower support cross beam 24. The arrangement shown in the Figures, however, provides a comfortable support for a user that minimizes, or completely removes, protrusions that could abut the user's lower back.

Figure 5:
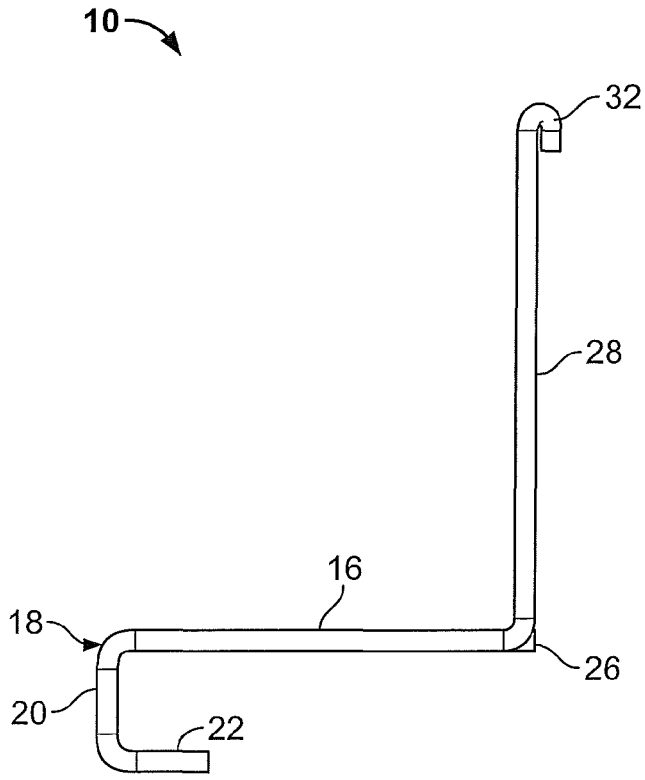
FIG. 5 illustrates a side view of a seat frame according to an embodiment of the present invention.

FIG. 5 illustrates a side view of the seat frame 10. The seat frame 10 is configured to form an upright support that is positioned over a stadium bench. The horizontal support arms 16 overlay a stadium bench while the forward hooks 18 hook underneath the front edge of the stadium bench. As noted above, the mounting receptacles 26 may be positioned underneath the lower support cross beam 24. The mounting receptacles 26 may be located in approximately the same horizontal plane defined by the horizontal support arms 16.

Figure 6:
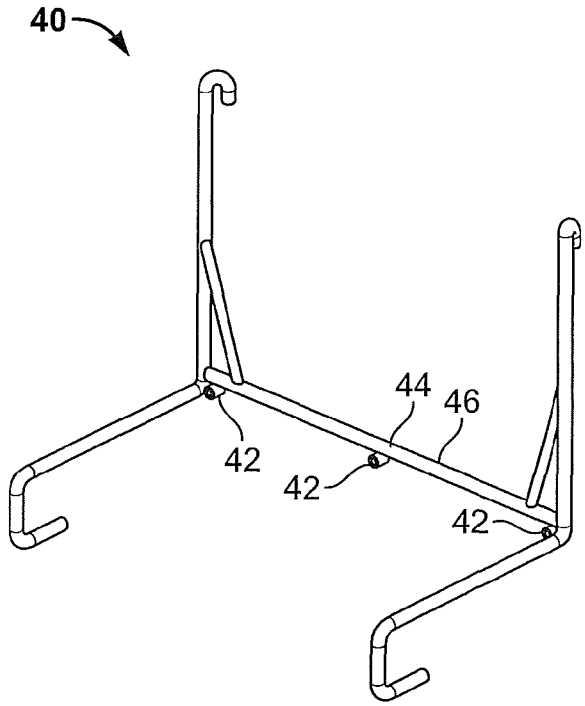
FIG. 6 illustrates an isometric view of seat frame according to an alternative embodiment of the present invention.

FIG. 6 illustrates an isometric view of seat frame 40 according to an alternative embodiment of the present invention. The seat frame 40 includes three mounting receptacles 42, including one mounting receptacle 42 positioned underneath the midpoint 44 of the lower support cross beam 46. While three mounting receptacles 42 are shown, more or less than those shown may be used. Further, the mounting receptacles 42 may be positioned at various points along the cross beam 46, and may optionally be positioned above the cross beam 46. Additional mounting receptacles 42 may be positioned on other parts of the seat frame 40, such as on the forward hooks 18 and the horizontal support arms 16.

Figure 7:
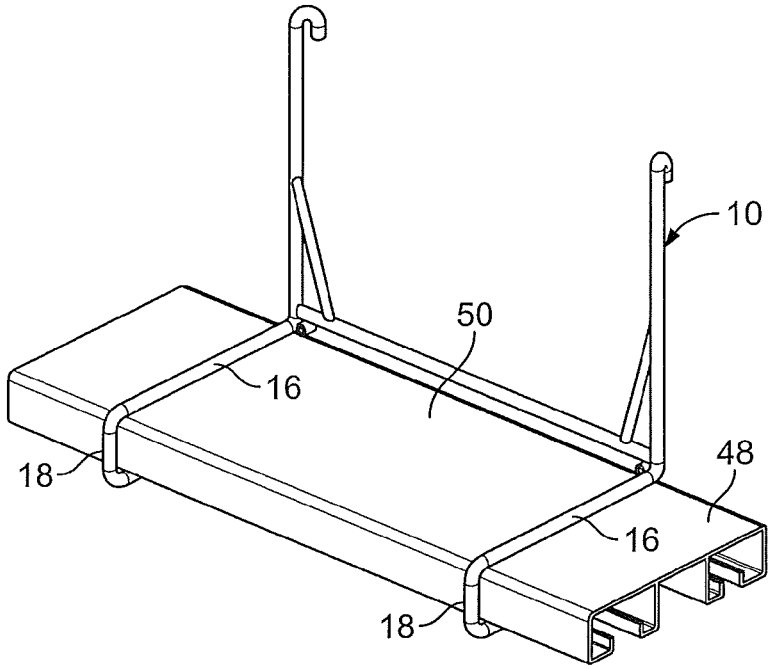
FIG. 7 illustrates an isometric view of a seat frame positioned over a stadium bench according to an embodiment of the present invention.

FIG. 7 illustrates an isometric view of the seat frame 10 positioned over a stadium bench 48. As shown in FIG. 7, the horizontal support arms 16 overlay a top surface 50 of the stadium bench 48, while the forward hooks 18 hook underneath the bench 48. The seat frame 10 is positioned over the stadium bench 48 in a similar fashion as that shown and described in U.S. Pat. No. 6,352,306, entitled "Stadium Seat," issued to Dreiling (the "'306 patent"), which is hereby incorporated by reference in its entirety.

Figure 8:
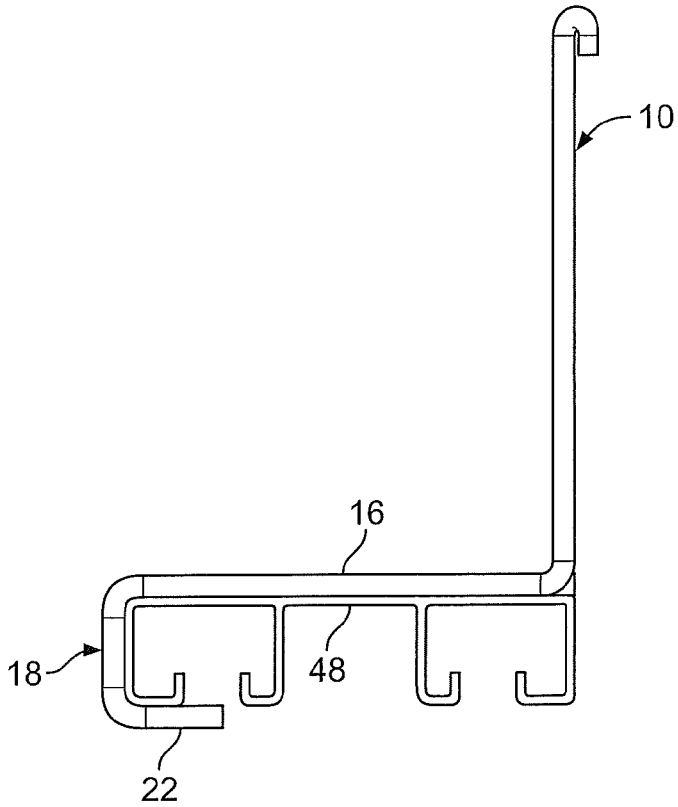
FIG. 8 illustrates a side view of a seat frame positioned over a stadium bench according to an embodiment of the present invention.

FIG. 8 illustrates a side view of the seat frame 10 positioned over the stadium bench 48. As shown in FIG. 8, the horizontal hooking arms 22 hook underneath the stadium bench 48.

Figure 9:
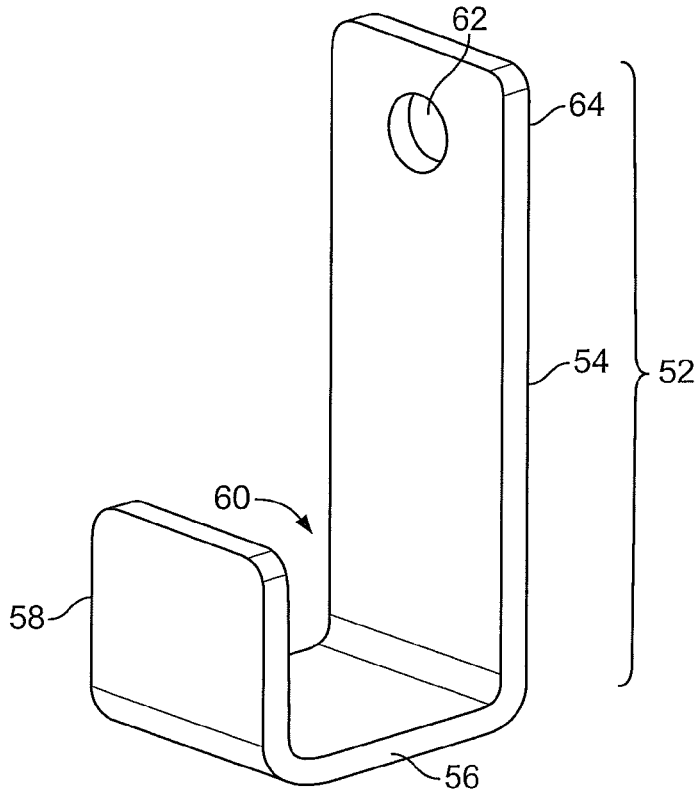
FIG. 9 illustrates an isometric view of a mounting bracket according to an embodiment of the present invention.

FIG. 9 illustrates an isometric view of a mounting bracket, or clamp, 52 according to an embodiment of the present invention. The mounting bracket 52 includes a frame-engaging upright member 54 integrally formed with a ledge 56, which is in turn integrally formed with a bench-engaging upright member 58. A bench cavity 60 is defined between the bench-engaging member 58 and the frame-engaging upright member 54. A fastener through-hole 62 is formed proximate an upper end 64 of the frame-engaging upright member 54. The through-hole 62 may be any shape or size that allows a fastener to pass therethrough. For example, the through-hole 62 may have an oblong, circular, elliptical, square, triangular, octagonal, or various other shapes. The mounting bracket 52 is configured to secure the frame 10 (shown, for example, in FIG. 1) to the stadium bench 48 (shown, for example, in FIGS. 7 and 8) similar to how the clamp described in the '306 patent is used to securely mount a stadium seat to a stadium bench.

Figure 10:
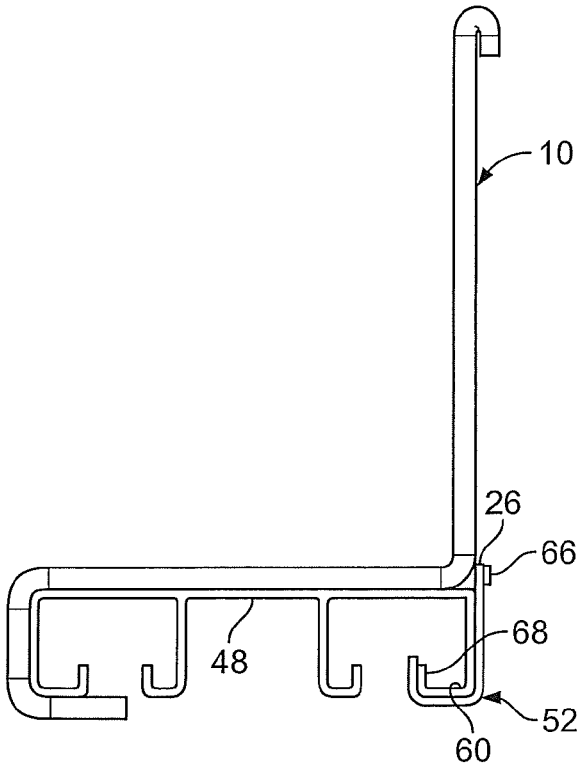
FIG. 10 illustrates a side view of a seat frame securely mounted to a stadium bench according to an embodiment of the present invention.

FIG. 10 illustrates a side view of the seat frame 10 securely mounted to the stadium bench 48. As shown in FIG. 10, the fastener through-hole 62 (shown in FIG. 9 above) of the mounting bracket 52 is aligned with a corresponding mounting bracket 26, while a flange 68 of the stadium seat 48 is positioned within the bench cavity 60 of the mounting bracket 52. A fastener 66, such as a screw, bolt, or the like, engages the mounting bracket 26 through the through-hole 62, thereby securing the mounting bracket 52 to the seat frame 10. The flange 68 of the stadium seat 48 is secured within the bench cavity 60 between the bench-engaging upright member 58 and the frame-engaging upright member 54. Thus, the seat frame 10 is securely fastened to the stadium seat 48, as further described in the '306 patent.

Figure 11:
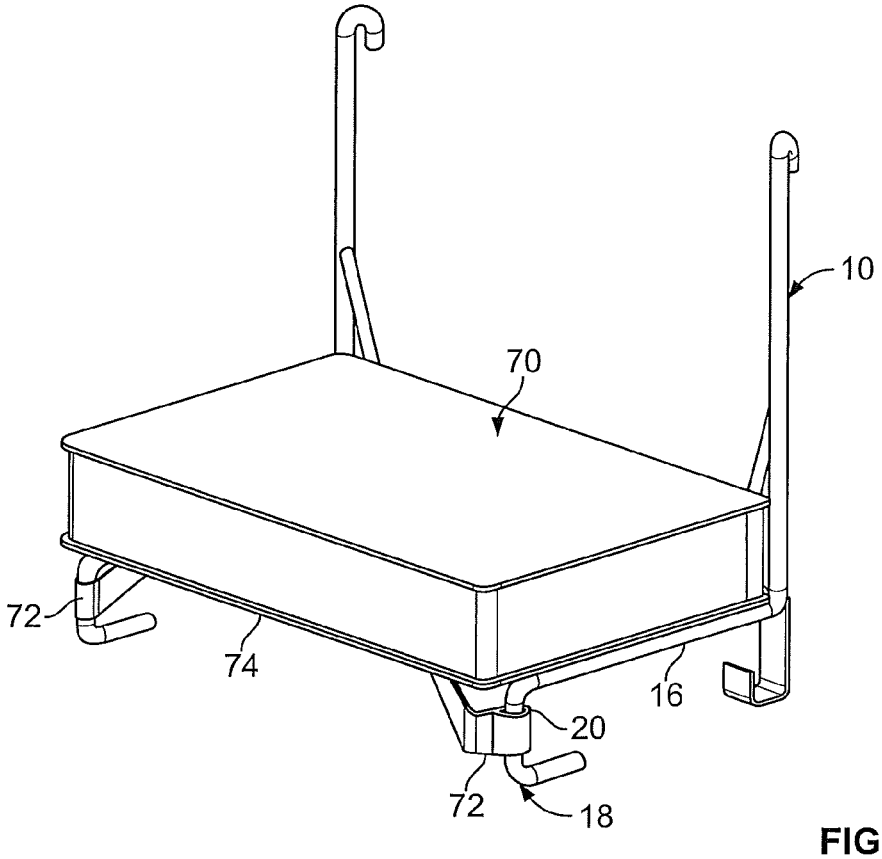
FIG. 11 illustrates an isometric view of a seat cushion positioned on a seat frame according to an embodiment of the present invention.
Figure 12:
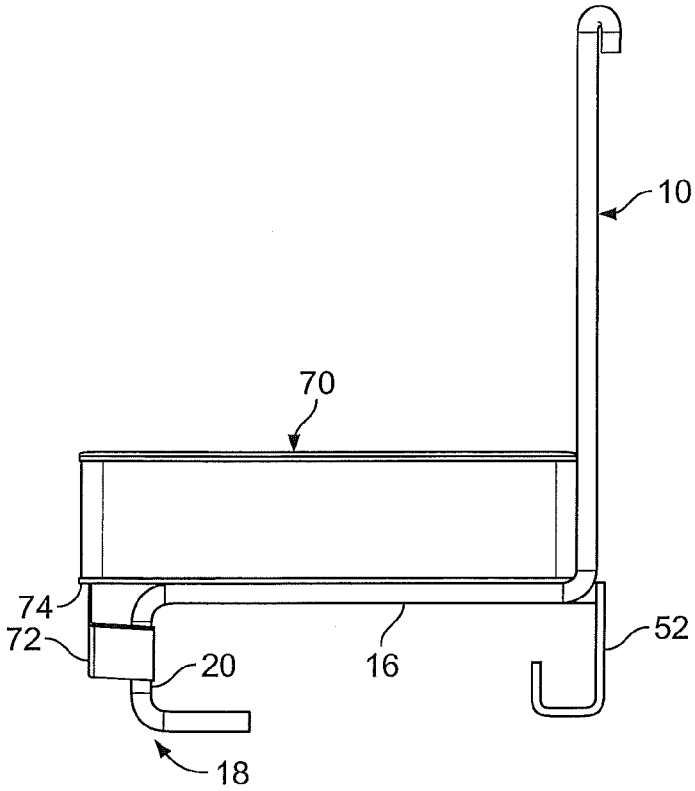
FIG. 12 illustrates a side view of a seat cushion positioned on a seat frame according to an embodiment of the present invention.
Figure 13:
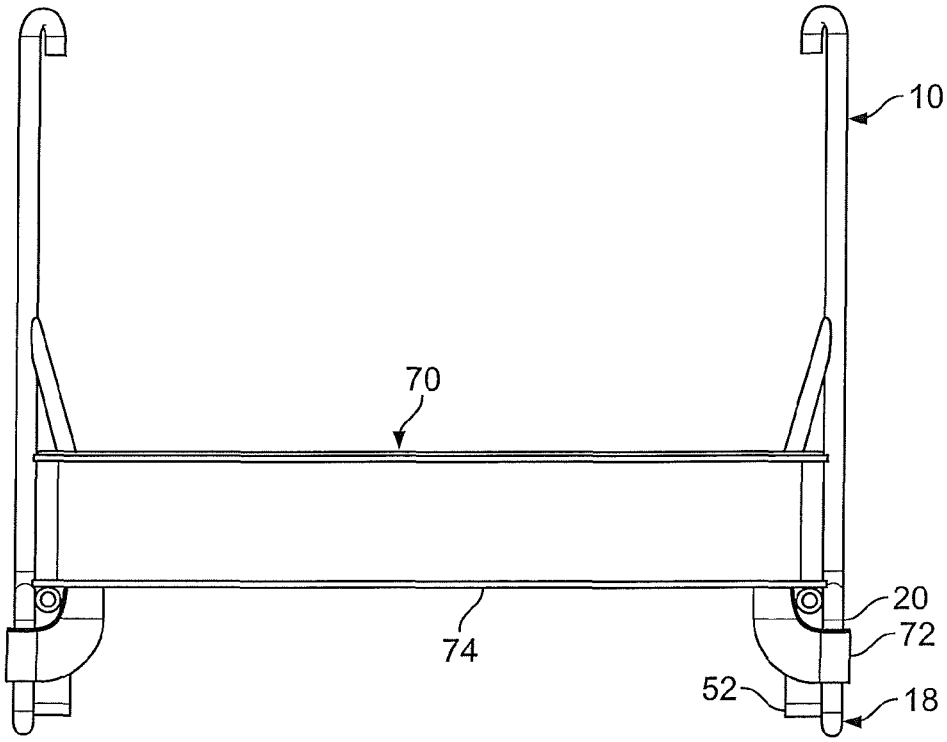
FIG. 13 illustrates a front view of a seat cushion positioned on a seat frame according to an embodiment of the present invention.

FIGS. 11, 12, and 13 illustrate isometric, side, and front views, respectively, of a seat cushion 70 positioned on the seat frame 10. Referring to FIGS. 11-13, the seat cushion 70 is positioned over the horizontal support arms 16 and provides a comfortable seating surface for a user. The seat cushion 70 may include a flexible, impermeable plastic shell containing a cushioning material, such as foam or gel.

The seat cushion 70 includes a pair of spaced loops 72 secured to a lower front edge 74. The spaced loops 72 are configured to loop around or otherwise attach to the forward hooks 18. The loops 72 may also attach to the mounting receptacles 26 located on the seat frame 10. In one embodiment of the invention, when the seat frame 10 is positioned over a stadium bench, the loops 72 are compressed or pinched between the vertical legs 20 and a front edge of the stadium bench. As such, the seat cushion 70 may be secured to the seat frame 10. Alternatively, the loops 72 may be positioned such that they are pinched between the horizontal support arms 16 and the top surface of the bench. The loops 72 may be positioned at various other positions of the seat cushion 70. For example, the loops 72 may be configured to loop around or otherwise attach to the horizontal support arms 16.

Figure 14:
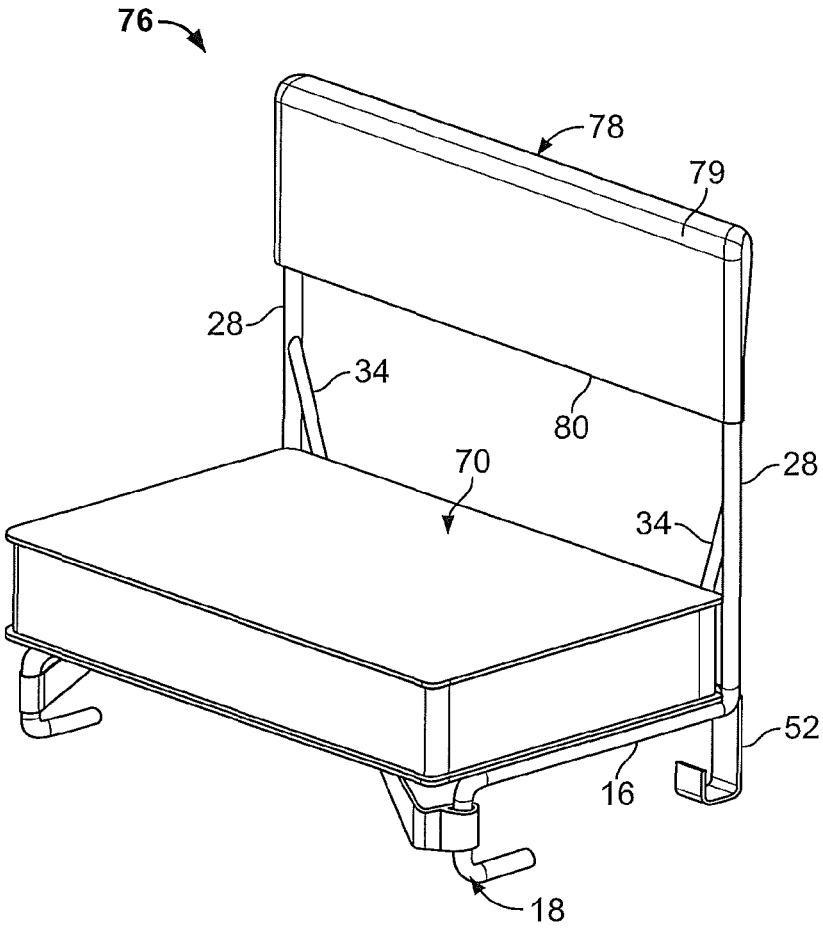
FIG. 14 illustrates an isometric view of a stadium seat according to an embodiment of the present invention.
Figure 15:
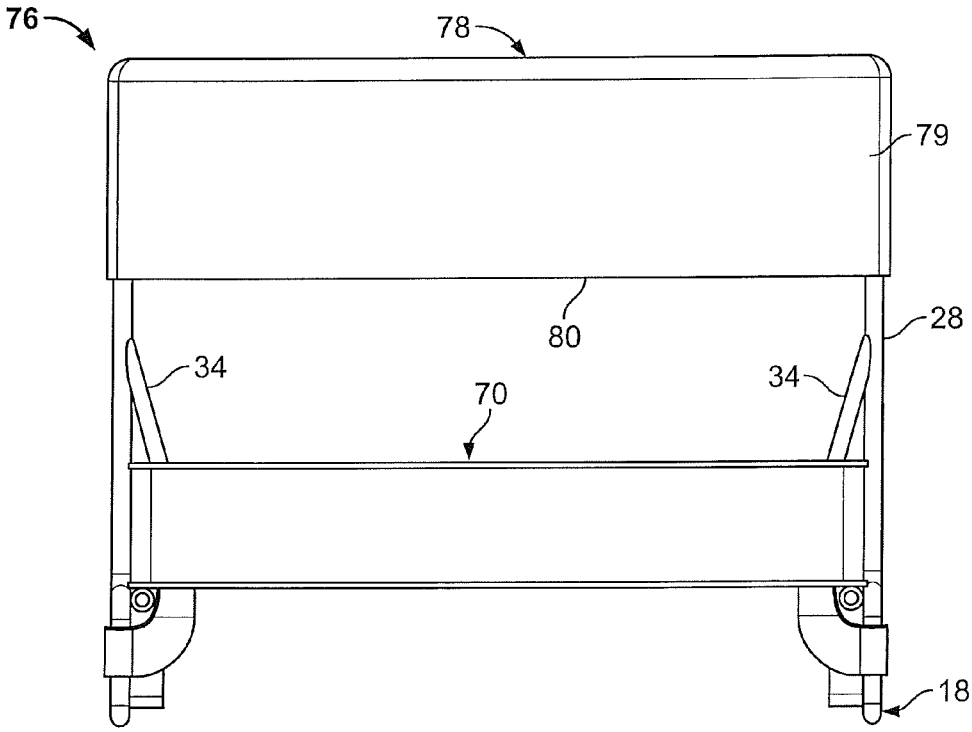
FIG. 15 illustrates a front view of a stadium seat according to an embodiment of the present invention.
Figure 16:
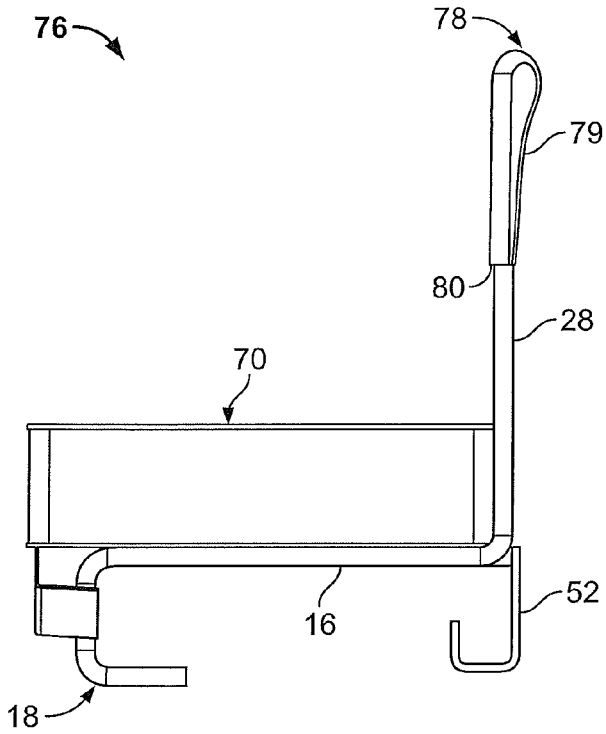
FIG. 16 illustrates a side view of a stadium seat according to an embodiment of the present invention.

FIGS. 14, 15, and 16 illustrate isometric, front, and side views of the stadium seat 76. The stadium seat 76 includes a flexible backrest 78 formed of a resilient, flexible material, such an elastomeric material, flexible plastic, or the like. The backrest 78 includes a cover 79 having an open lower end 80 that allows access to an interior cavity (not shown). The backrest 78 is positioned on the support members 28 such that the upper rounded ends 32 (shown, for example, in FIG. 1-5) are positioned within the interior cavity and covered by the cover 79. The rearwardly canted upper round ends 32 assist in keeping the backrest 78 stretched and taut. As shown in FIG. 16, the profile of the stadium seat 76 protrudes less out into walking aisles as compared with the embodiments shown in the Jones '667 patent.

The stadium seat 76 does not include an upper cross beam connecting the upper ends of the support members 28. Thus, there is no rigid beam at the top of the stadium seat to cause discomfort to a user. Further, because there is no upper cross beam, the backrest 78 conforms to the back of a user when the user sits back in the stadium seat 76. In essence, the backrest 78, when suspended between the support members 28, conforms or molds to the shape and curvature of the upper back of a user. When a user sits back in the stadium seat 76, the braces 34 ensure that the support members 28 remain substantially upright. When the user leaves the chair, the backrest 78 returns to its original shape.

The rounded edges of the upper ends 32 (shown, for example, in FIGS. 1-5) provide a safer stadium seat 76. That is, the upper ends 32, because they are rounded, do not have a sharp, pointed, or otherwise dangerous surface. Injuries resulting from a user grasping, grazing, hitting, or otherwise encountering the upper ends 32, are therefore minimized. Further, susceptibility of the backrest being snagged or torn by the upper ends 32 is also minimized due to the fact the upper ends are rounded and smooth.

Figure 17:
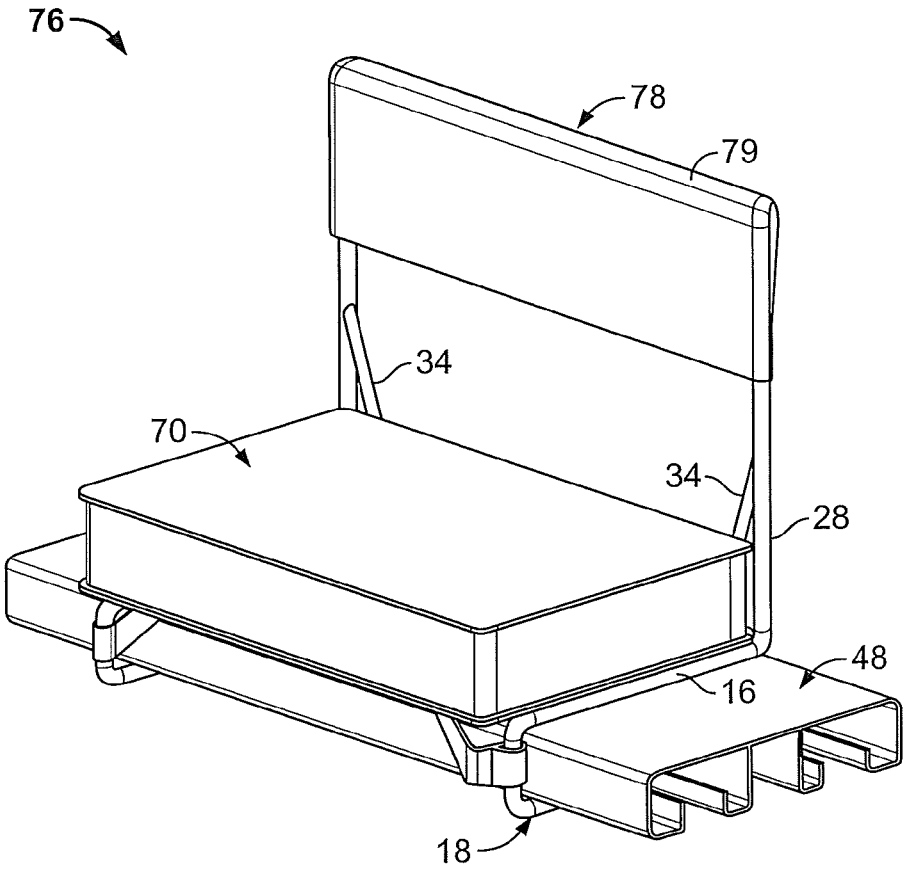
FIG. 17 illustrates an isometric view of a stadium seat securely mounted to a stadium bench according to an embodiment of the present invention.

FIG. 17 illustrates an isometric view of the stadium seat 76 securely mounted to the stadium bench 48. The stadium seat 76 may be used on stadium benches, bleachers, boards, planks, or the like, to provide a more comfortable seating environment.

Thus, embodiments of the present invention provide a comfortable stadium seat. In particular, embodiments of the present invention provide an improved stadium seat that provides adequate support to a user, while at the same time comfortably conforming to the shape of the user's back.

Figure 18:
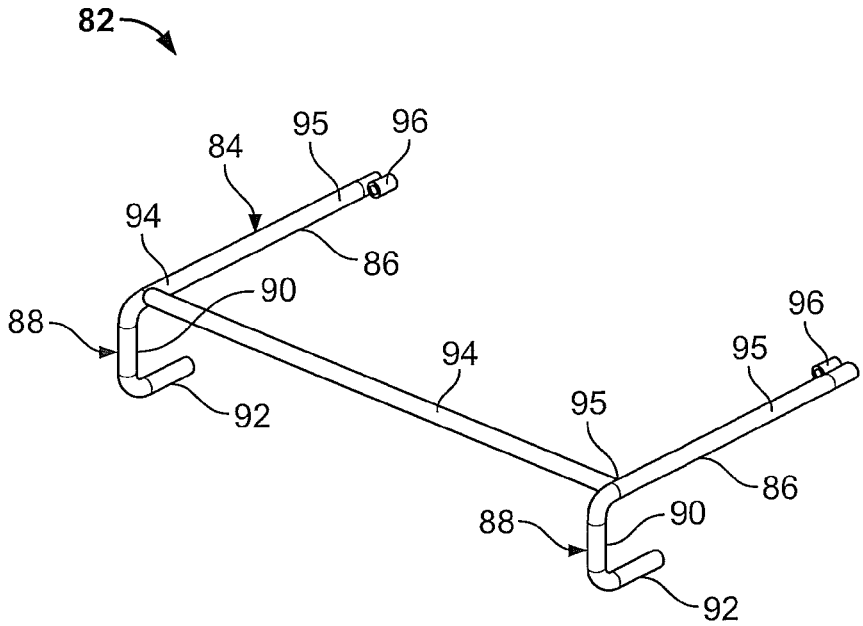
FIG. 18 illustrates an isometric view of a backless seat frame according to an embodiment of the present invention.

FIG. 18 illustrates an isometric view of a backless seat frame 82 according to an embodiment of the present invention. The seat frame 82 includes a seat portion 84, but does not include a back portion. The seat portion 84 includes horizontal support arms 86 integrally connected to forward hooks 88. The horizontal support arms 86 are adapted to mount over a seating area of a stadium bench or bleacher (not shown in FIG. 1). Each hook 88 includes a vertical leg 90, which is configured to extend downwardly along a front wall of the stadium bench, and a horizontal hooking arm 92, which is configured to extend rearwardly beneath the stadium bench.

A lower support cross beam 94 is integrally connected to the horizontal support arms 86 proximate their front ends 95. As shown in FIG. 18, the lower support cross beam 94 is located proximate the forward hooks 88. Alternatively, the lower support cross beam 94 may be located proximate the rear of the seat frame 82. Also, alternatively, the seat frame 82 may include multiple lower support cross beams 94 near front and rear ends. For example, one lower support cross beam 94 may extend between points proximate the forward hooks 88, while another lower support cross beam 94 may extend between rear ends 95 of the horizontal support arms 86. The lower support cross beam 94 is horizontally oriented and perpendicular to each of the horizontal support arms 86. Mounting receptacles 96 are integrally connected proximate the rear ends 95 of the horizontal support arms 86. The mounting receptacles 96 may also be positioned on other parts of the frame 82, such as the forward hooks 88 or the horizontal support arms 86.

Figure 19:
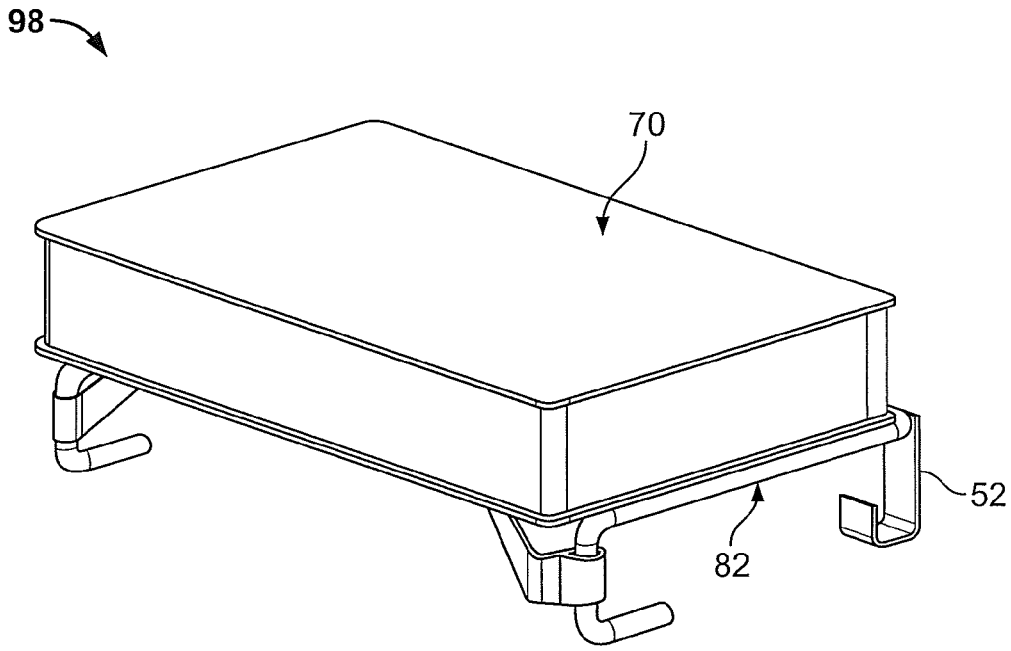
FIG. 19 illustrates an isometric view of a stadium seat including a seat cushion positioned on a backless seat frame according to an embodiment of the present invention.
Figure 20:
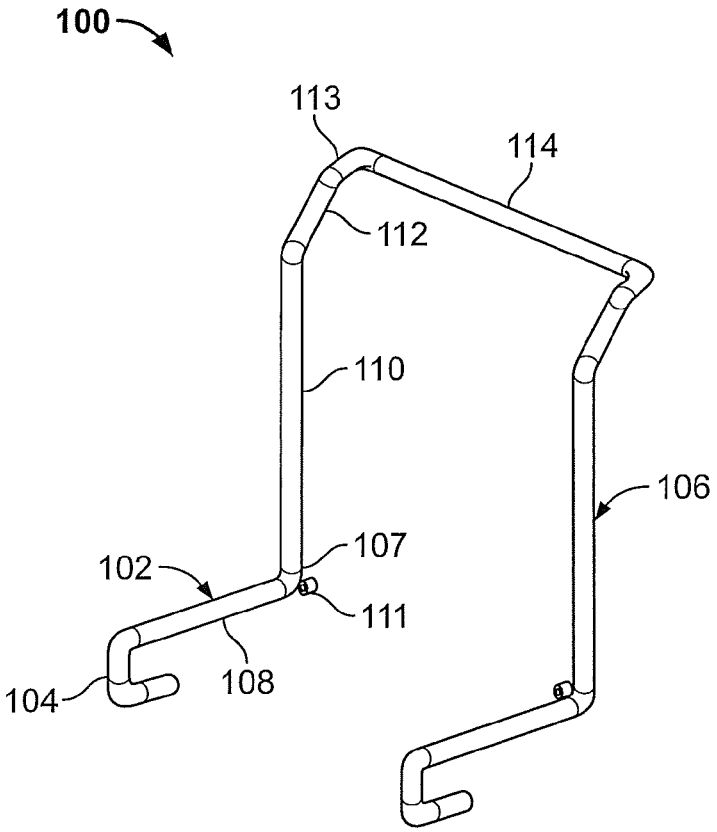
FIG. 20 illustrates an isometric view of a seat frame according to an alternative embodiment of the present invention.
Figure 21:
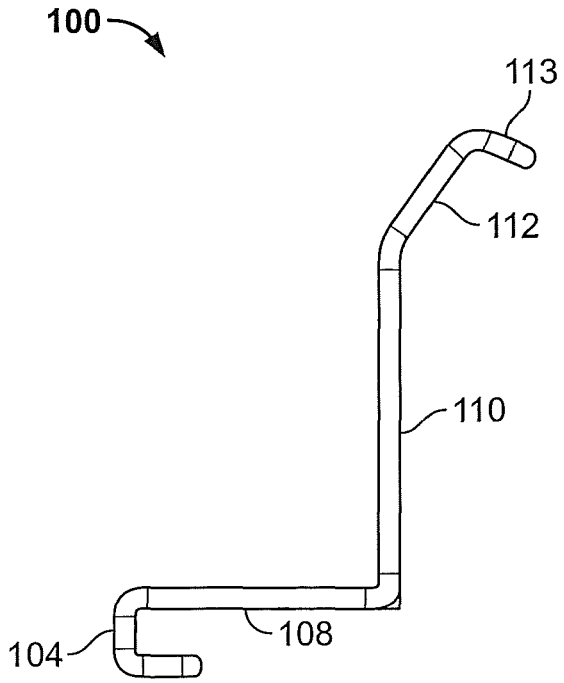
FIG. 21 illustrates a side view of a seat frame according to an alternative embodiment of the present invention.
Figure 22:
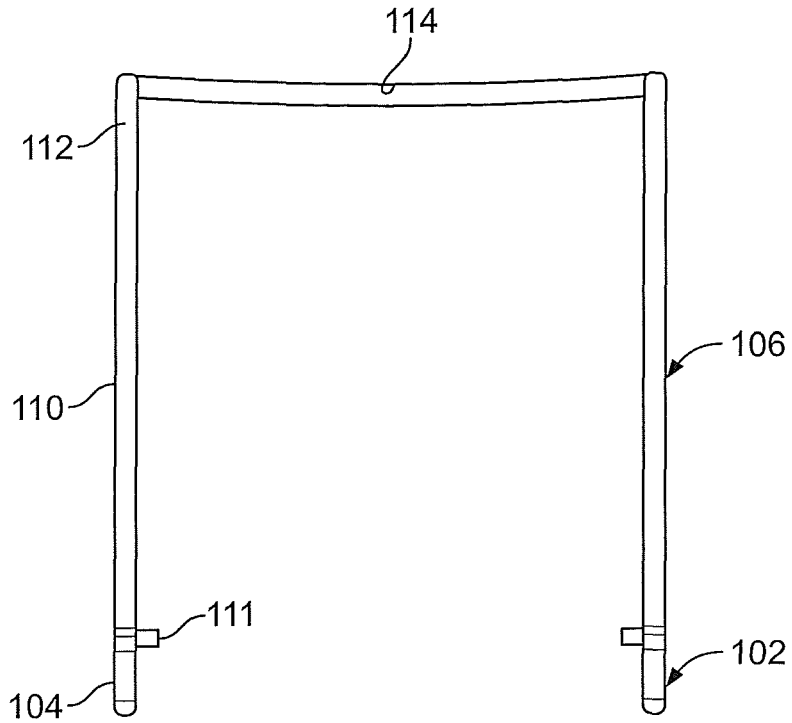
FIG. 22 illustrates a front view of a seat frame according to an alternative embodiment of the present invention.
Figure 23:
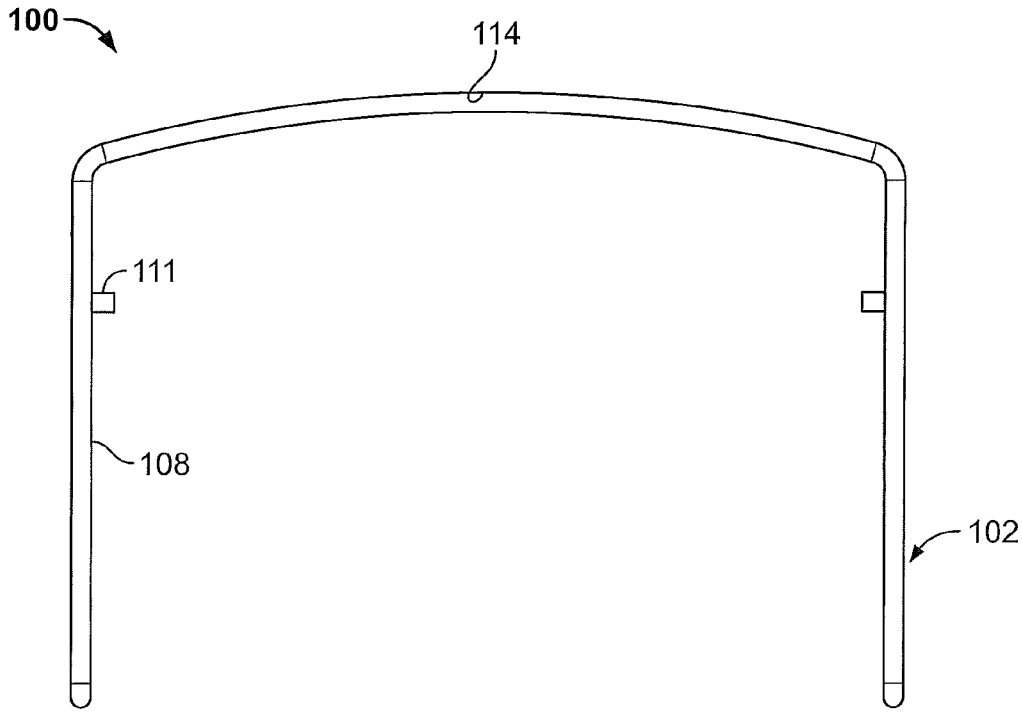
FIG. 23 illustrates a top view of a seat frame according to an alternative embodiment of the present invention.
Figure 24:
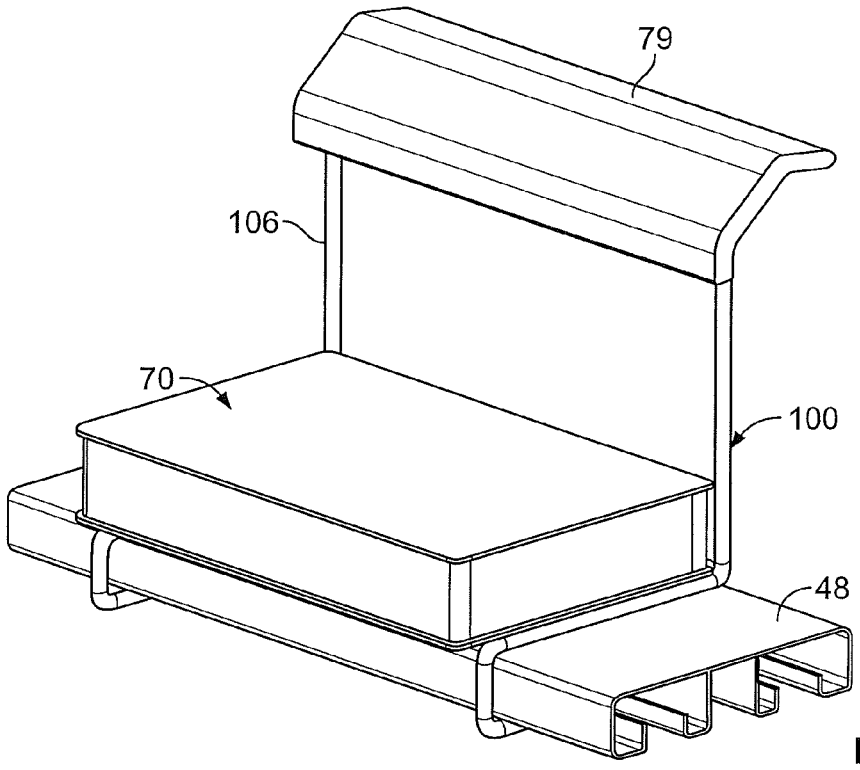
FIG. 24 illustrates an isometric view of a stadium seat secured to a stadium bench according to an alternative embodiment of the present invention.
Figure 25:
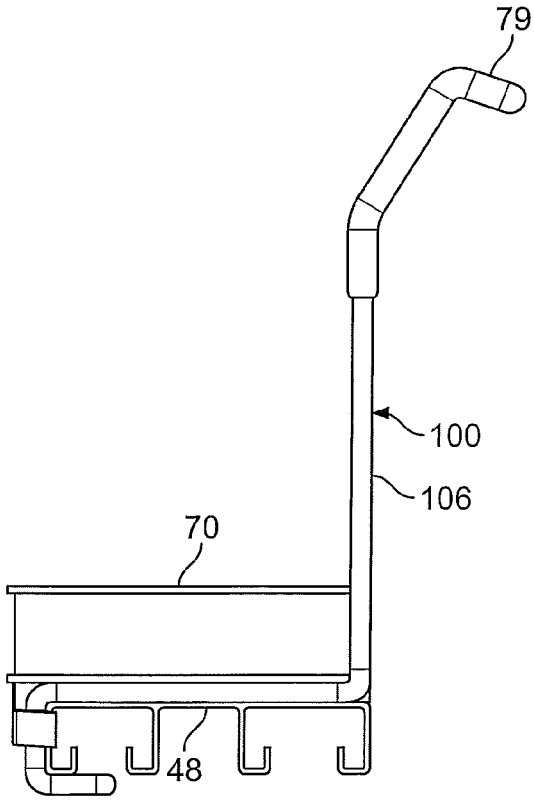
FIG. 25 illustrates a side view of a stadium seat secured to a stadium bench according to an alternative embodiment of the present invention.
Figure 26:
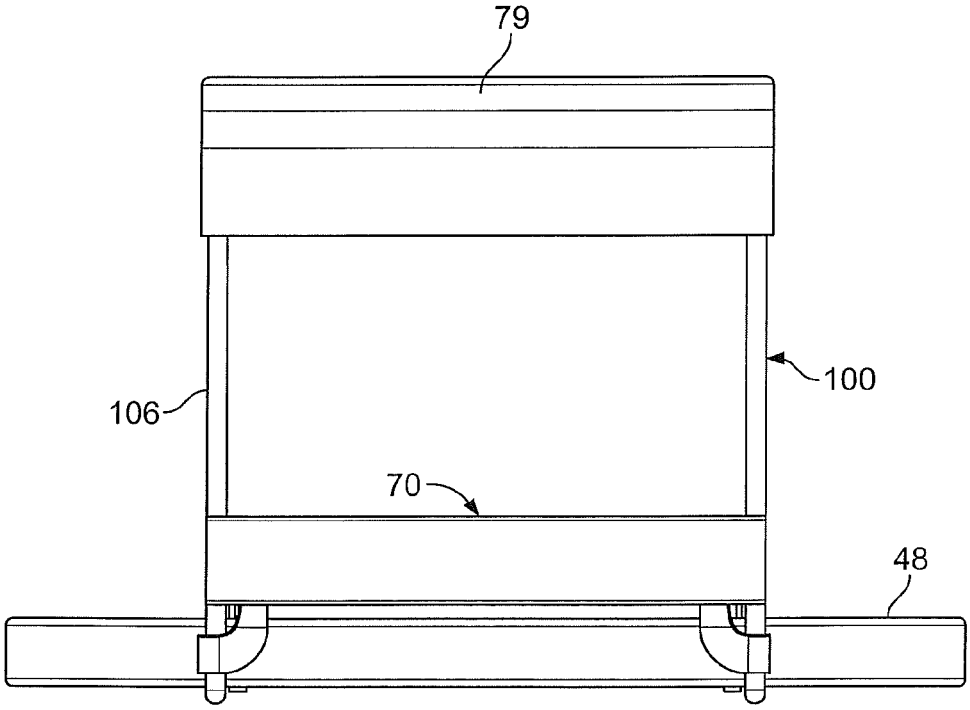
FIG. 26 illustrates a front view of a stadium seat secured to a stadium bench according to an alternative embodiment of the present invention.
Figure 27:
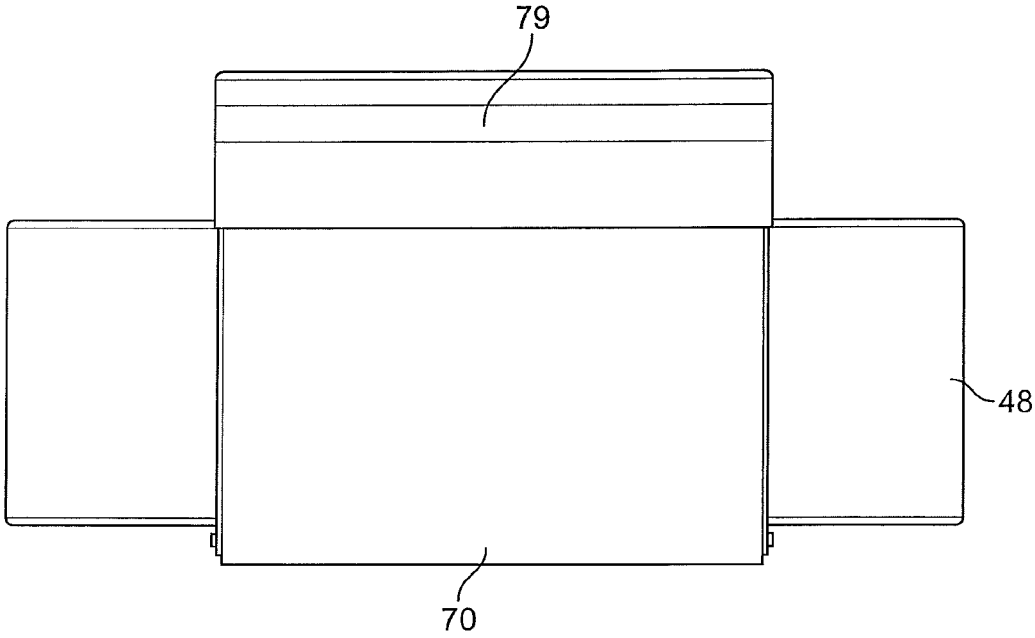
FIG. 27 illustrates a top view of a stadium seat secured to a stadium bench according to an alternative embodiment of the present invention.

FIG. 19 illustrates an isometric view of the stadium seat 98 including the seat cushion 70 positioned on the backless seat frame 82. The mounting brackets 52 are secured to the mounting receptacles 96 as discussed above with respect to FIGS. 9-10. Additionally, the seat cushion 70 is secured to the seat frame 82 through the spaced loops 72, as discussed above with respect to FIGS. 11-14. Further, the stadium seat 98 is secured to a stadium bench, such as stadium bench 48, as described above with respect to, for example, FIGS. 7-8, 10, and 17.

FIGS. 20, 21, 22, and 23 illustrate isometric, side, front, and top view, respectively, of a seat frame 100 according to an alternative embodiment of the present invention. The seat frame 100 does not include a lower support cross beam, such as those described above with respect to, for example, FIG. 1. The seat frame 100 includes a seat portion 102 having forward hooks 104. The seat portion 102 is integrally connected to a back portion 106. In particular, rear ends 107 the horizontal support arms 108 are integrally connected to lower ends of the upright supports 110 of the seat portion 102. Additionally, mounting receptacles 111 are located proximate the junction of the horizontal supports arms 108 and the upright supports 110.

Upper ends of each upright support 110 integrally connect to a rearwardly-canted intermediate back-rest support 112. A bowed upper support cross beam 114 is integrally connected to, and spans between, distal ends 113 of the rearwardly-canted intermediate back-rest supports 112. The upper support cross beam 114 is shaped to conform to the shape of a mid-to-upper portion of a human back.

As mentioned above, the seat frame 100 does not include lower support cross beams. Alternatively, however, the seat frame 100 may include at least one lower support cross beam.

FIGS. 24, 25, 26, and 27 illustrates isometric, side, front, and top views, respectively of a stadium seat 120 secured to the stadium bench 48 according to an alternative embodiment of the present invention. The seat cushion 70 is secured to the seat portion 102 of the seat frame 100, similar to how the seat cushion is secured to the seat frame 10 of FIG. 1. Additionally, the cover 79 is positioned over a top portion of the back portion 106, including the back rest support 112 (shown in FIGS. 20-23), and the bowed upper support cross beam 114 (shown in FIGS. 20-23), thereby forming a flexible backrest.

Figure 28:
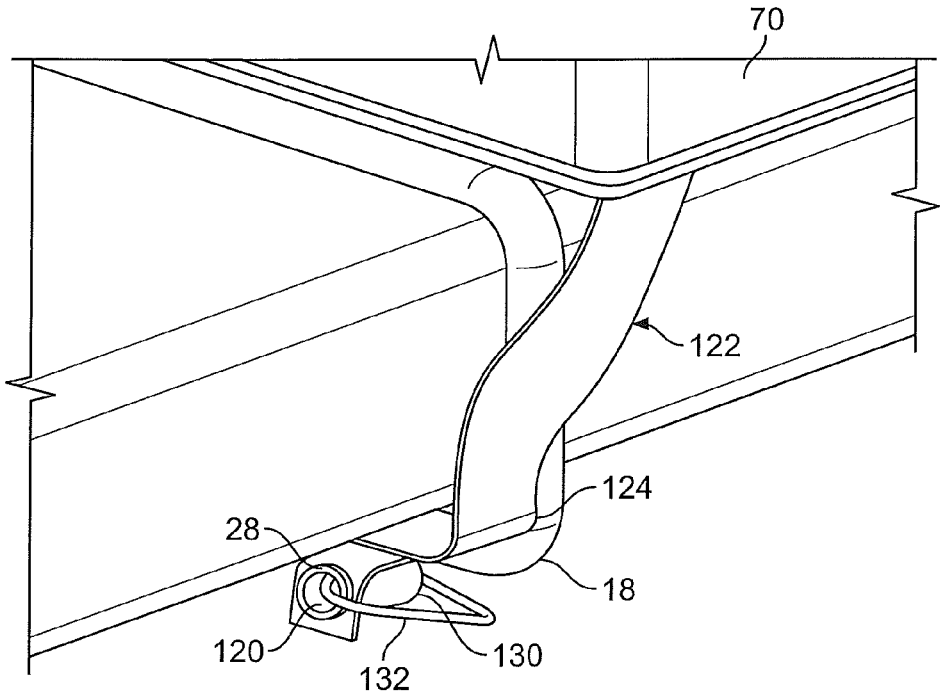
FIG. 28 illustrates an isometric view of a securing strap of a seat cushion according to an embodiment of the present invention.

FIG. 28 illustrates an isometric view of a securing strap 122 of a seat cushion 70 according to an embodiment of the present invention. The securing strap arrangement shown in FIG. 28 may be used in place of, or in addition to, the embodiments of the spaced loops shown and described with respect to FIGS. 1-27. The securing strap 122 includes a resilient main flexible body 124 having one end fixed to a lower edge portion of the seat cushion, and a free end having a hole 126 formed therethrough. The hole 126 may be formed through a plastic or metal ring 128 secured within the free end of the strap 122.

As shown in FIG. 28, the forward hooks 18 may include a strap securing member 130, such as a tube, cylinder or ring. A clip 132 is removably secured within the strap securing member 130. The free end of the strap 122 is positioned adjacent to the strap securing member so that the hole 126 is aligned with a central passage of the strap securing member 130. The clip 132 is then opened so that it may also be positioned through the hole 126. The clip 132 is then closed, thereby securing the strap 122 to the strap securing member 130.

Figure 29:
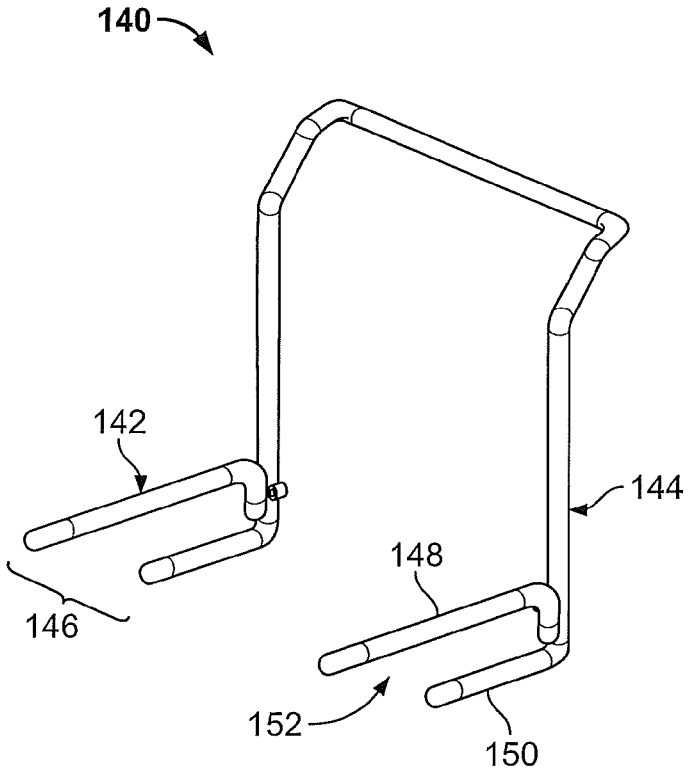
FIG. 29 illustrates an isometric view of a seat frame according to an alternative embodiment of the present invention.
Figure 30:
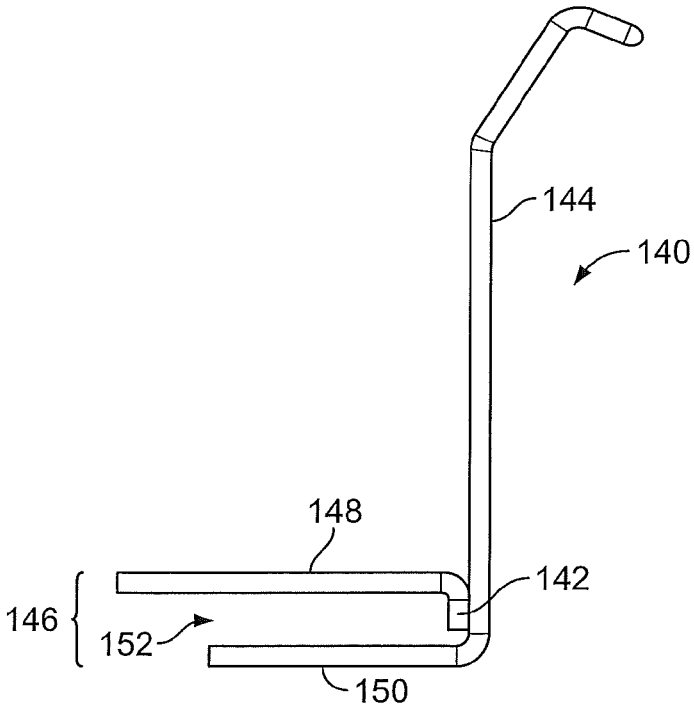
FIG. 30 illustrates a side view of a seat frame according to an alternative embodiment of the present invention.

FIGS. 29 and 30 illustrate isometric and side views, respectively, of a seat frame 140 according to an alternative embodiment of the present invention. The seat frame 140 includes a seat portion 142 and a back portion 144. The seat portion 142 may be used in the embodiments shown and described in FIGS. 1-28.

The seat portion 142 includes a double-pronged bench engagement member 146 including an upper horizontal prong 148 and a lower horizontal prong 150 separated by a bench retention cavity 152. The upper horizontal prong 148 may be longer than the lower horizontal prong 150. The upper horizontal prong 148 may be configured to overlay a substantial portion of the width of a stadium bench.

Figure 31:
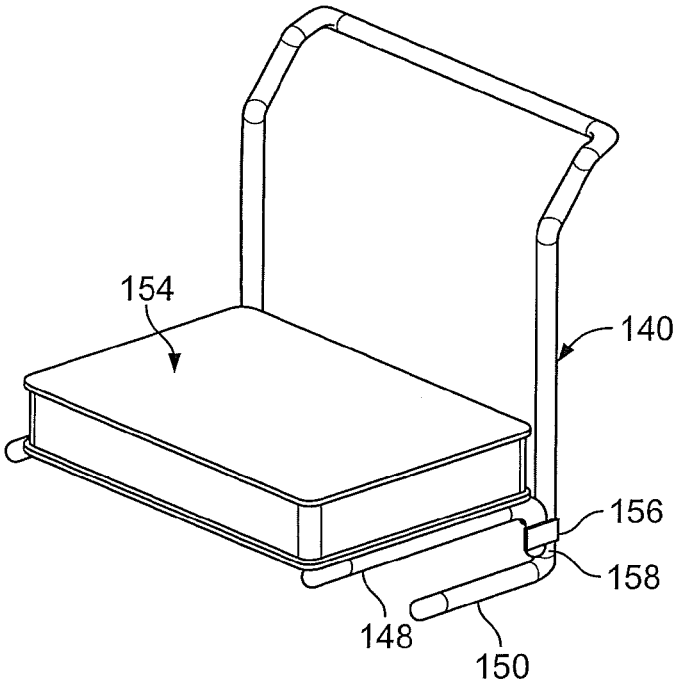
FIG. 31 illustrates an isometric view of a seat cushion secured to a seat frame according to an alternative embodiment of the present invention.
Figure 32:
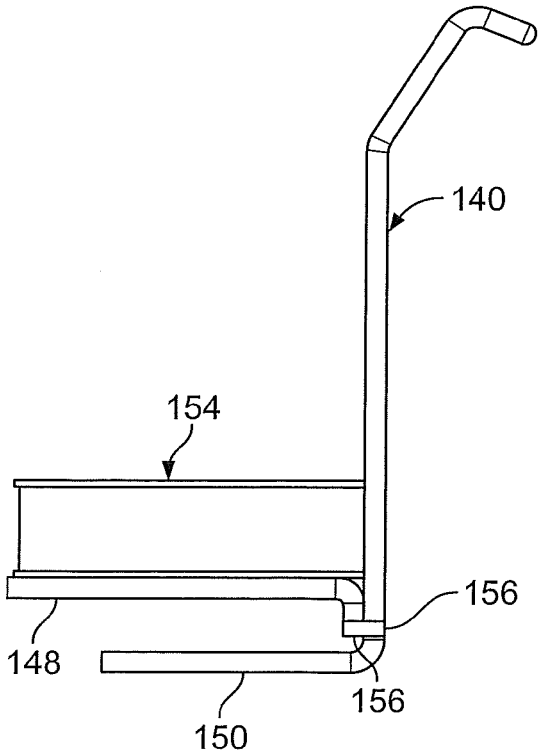
FIG. 32 illustrates a side view of a seat cushion secured to a seat frame according to an alternative embodiment of the present invention.

FIGS. 31 and 32 illustrate isometric and side views, respectively, of a seat cushion 154 secured to the seat frame 140. The securing straps 156 extend outwardly from a lower rear edge of the seat cushion 154, and are configured to loop around, or otherwise secure to, an intermediate upright 158 positioned between the upper and lower horizontal prongs 148 and 150.

Figure 33:
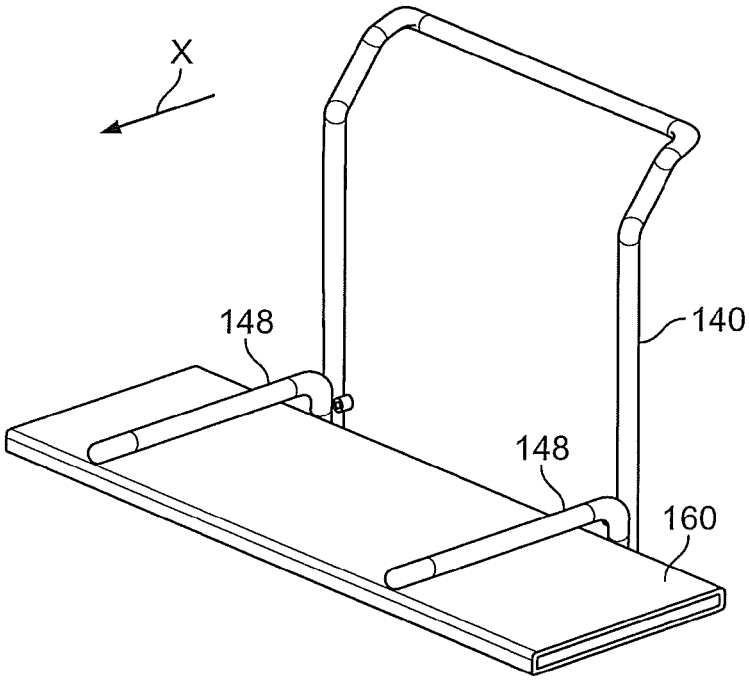
FIG. 33 illustrates an isometric view of a seat frame mounted on a stadium bench according to an alternative embodiment of the present invention.
Figure 34:
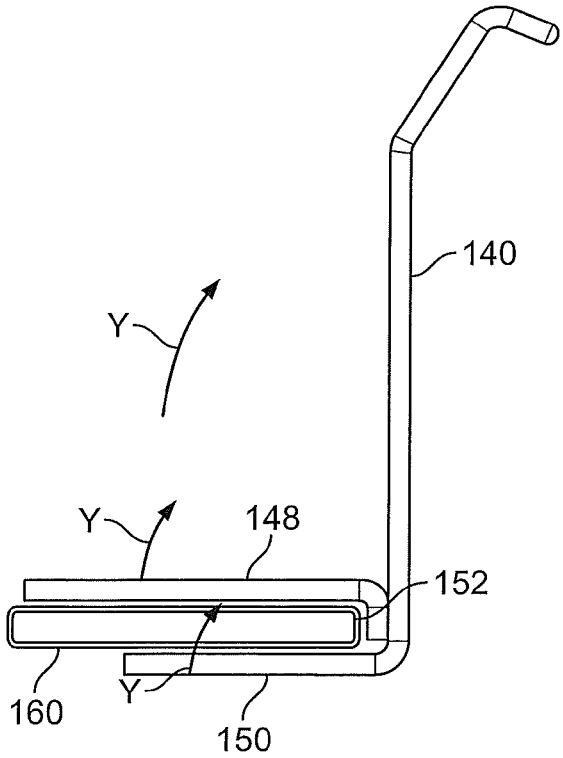
FIG. 34 illustrates a side view of a seat frame mounted on a stadium bench according to an alternative embodiment of the present invention.
Figure 35:
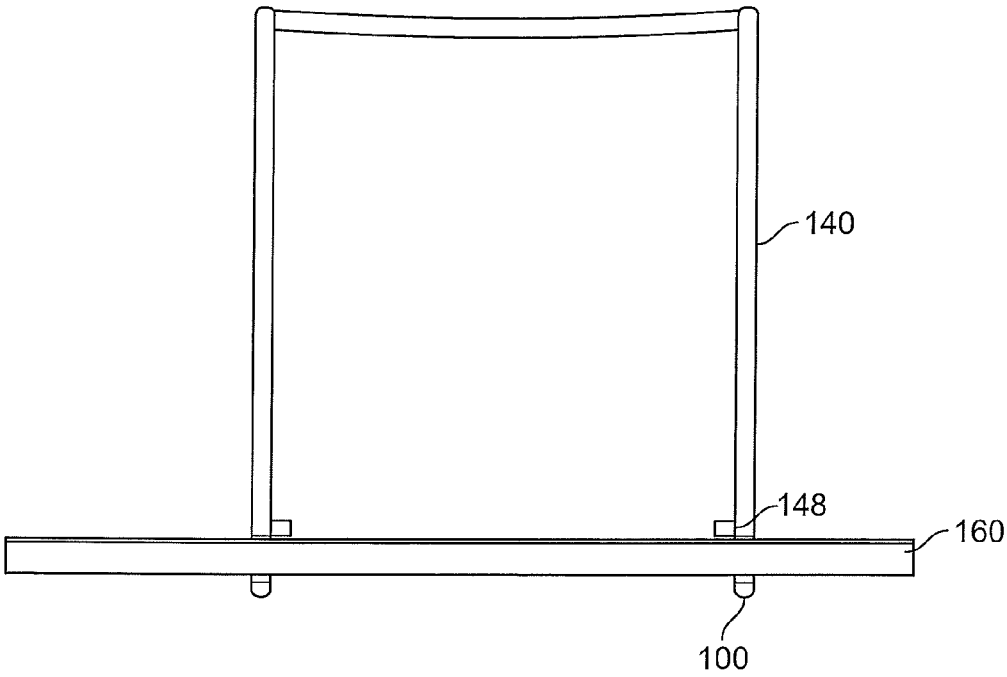
FIG. 35 illustrates a front view of a seat frame mounted on a stadium bench according to an alternative embodiment of the present invention.

FIGS. 33, 34, and 35 illustrate isometric, side and front views of the seat frame 140 mounted on a stadium bench 160. In order to mount the mount the seat frame 140 to the stadium bench 150, the bench retention cavity 152 is aligned with the bench 160 and the seat frame 140 is urged into the bench in the direction of arrow X. As the seat frame 140 is urged into the stadium bench, the upper and lower horizontal prongs 148 and 150 compressively sandwich the bench 160 therebetween in the bench retention cavity 152. As shown in FIG. 34 in particular, if a person leans back on the seat frame 140 in the direction of arrow Y, the sandwiching of the stadium bench 160 between the prongs 148 and 150 will ensure than the seat frame 140 is not displaced from the bench 160.

Optionally, straps, clamps, latches, or other securing members may be secured between ends of the prongs. For example, a strap may be secured to a free, distal end of an upper prong 148 and be configured to securably mate with a corresponding structure formed or attached to a free, distal end of a counterpart lower prong 150. Once the seat frame is positioned onto the bench 160, the securing members may be fixed into a securing position, thereby providing additional assurance that the seat frame 140 will not be dislodge from the bench 160.

Overall, embodiments of the present invention provide an improved stadium seat that is easy to secure to a stadium bench and comfortably supports a user.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments disclosed, but that the invention will include all embodiments falling within the scope of the appended claims.

The invention claimed is:

1. An open-backed seat frame for semi-permanent attachment to a stadium bench supported on a stadium riser, the seat frame comprising:

bench-engaging support arms having each a front portion and a rear portion, said front portion of said bench-engaging support arms including forward hooks configured to engage the stadium bench to which said seat frame is attachable, said forward hooks comprising a lower prong integrally connected to one of said bench-engaging support arms through an intermediate upright;

upright support members that connect to said bench-engaging support arms, said upright support members oriented substantially perpendicularly to said bench-engaging support arms, said upright support members having an upper portion, a midpoint and a lower portion, each of said upright support members integrally formed with the bench-engaging support arm to which it connects;

an open area defining a vertical plane between said upper portions of upright support members that is devoid of any cross beams;

a seat frame securing strap for securing said seat frame to said stadium bench;

mounting receptacles configured to receive the seat frame securing strap for securing said seat frame to said stadium bench;

said upright support members each including an upright bar and a rounded upper end formed by a bend in said upright bar, and wherein said rounded upper ends are coplanar with a substantially vertical plane occupied by the upright support members.

2. The seat frame of claim 1 wherein said rounded upper ends are substantially U-shaped.

3. The seat frame of claim 1 wherein at least some of said mounting receptacles are located on said forward hooks.

4. The seat frame of claim 1 wherein at least some of said mounting receptacles are located on said rear portion of said bench-engaging support arms.

5. The seat frame of claim 4 wherein the at least some of said mounting receptacles located on said rear portion of said bench-engaging support arms are substantially coplanar with said bench-engaging support arms.

6. The seat frame of claim 1 wherein at least some of said mounting receptacles are located on said forward hooks, and at least some others of said mounting receptacles are located on said rear portion of said bench-engaging support arms.

7. The seat frame of claim 6 wherein the at least some others of said mounting receptacles located on said rear portion of said bench-engaging support arms are substantially coplanar with said bench-engaging support arms.

8. The seat frame of claim 1 wherein at least some of said mounting receptacles are substantially coplanar with said bench-engaging support arms.

9. The seat frame of claim 1 further comprising a seat cushion, the seat cushion comprising at least one cushion securing strap for securing the seat cushion proximate to the front portion of one of the bench-engaging support arms.

10. The seat frame of claim 9, wherein the cushion securing strap is configured to be looped around one of the forward hooks.

11. The seat frame of claim 9, wherein the cushion securing strap comprises a loop secured to a lower front edge of the seat cushion.

12. The seat frame of claim 9, wherein the cushion securing strap includes one fixed end and one free end, the fixed end being fixed to a lower front edge portion of the seat cushion.

13. The seat frame of claim 12, wherein the free end of the cushion securing strap comprises a hole formed through the securing strap.

14. The seat frame of claim 13 comprising a cushion strap securing member located proximate to one of the forward hooks, and comprising a clip for securing the cushion securing strap to the cushion strap securing member, wherein the cushion strap securing member includes a central passage that is aligned with the hole in the free end of the cushion securing strap when the cushion securing strap is secured to the cushion strap securing member by the clip.

15. The seat frame of claim 9 comprising a cushion strap securing member, wherein the cushion securing strap is secured to the cushion strap securing member with a clip.

16. The seat frame of claim 1, comprising a flexible backrest suspended between the upright support members.

17. The seat frame of claim 1 wherein at least some of the mounting receptacles are elongate and include a hollow central passageway.

18. The seat frame of claim 17, wherein the at least some of the mounting receptacles that are elongate have a substantially cylindrical outer surface.

* * * * *